US005230174A

United States Patent [19]

Reed

[11] Patent Number: 5,230,174

[45] Date of Patent: Jul. 27, 1993

[54] DIRECTIONAL INFORMATION SIGN

[75] Inventor: A. Harold Reed, Elk Grove Village, Ill.

[73] Assignee: Robert Neilsen & Associates, Ltd., Rolling Meadows, Ill.

[21] Appl. No.: 750,639

[22] Filed: Aug. 27, 1991

[51] Int. Cl.[5] ..... G09F 7/00

[52] U.S. Cl. ..... 40/492; 40/594; 248/291; 116/303; 16/335; 403/92

[58] Field of Search ..... 40/5, 492, 533, 536, 40/594, 591; 248/205.3, 288.3, 291, 487, 481; 116/303; 16/335, 375, 224, 227; 403/91, 92, 95

[56] References Cited

U.S. PATENT DOCUMENTS 2,845,729 8/1958 Baumgart ..... 40/492 X
3,916,547 11/1975 Ryder ..... 40/553
4,066,231 1/1978 Bahner et al. ..... 248/288.3 X
4,270,291 6/1981 Babberl ..... 40/594
4,605,292 8/1986 McIntosh ..... 248/205.3 X
4,885,857 12/1989 Leflet ..... 40/533

*Primary Examiner*—Kenneth J. Dorner
*Assistant Examiner*—Brian K. Green
*Attorney, Agent, or Firm*—Lee, Mann, Smith, McWilliams, Sweeney & Ohlson

[57] ABSTRACT

A sign to provide directional information for a check out lane. The sign has a fixed part that is attached to an appropriate surface and which displays advertising or other indicia, and a pivotal part which is hinged to the fixed part and which has directional indicia on opposed faces thereof. In one orientation, the pivotal part is raised to signify that the check out lane is closed. In a second orientation, the pivotal part is folded down over the fixed part to signify that the lane is open. The hinge is provided with an internal stop for positively positioning the pivotal part in either of the two orientations.

17 Claims, 2 Drawing Sheets

DIRECTIONAL INFORMATION SIGN

BACKGROUND OF THE INVENTION

This invention relates to directional signs, and more particularly to a sign having a pivotal part which is used to indicate the availability of, or closure of, a check out lane in a supermarket or other retail establishment.

Check out lanes in supermarkets and other establishments where customers gather goods for subsequent purchase are opened and closed depending on the number of customers in the establishment, and the availability of personnel for checking out customers. When lanes are closed, sometimes a chain may be drawn across the lane, or a sign is placed on the lane, or a shopping cart is strategically positioned in the passageway next to the lane to indicate to the customer that the lane is closed. However the closure may be signified, the process is either cumbersome, or utilizes loose signs or other parts that can be lost or mislaid, or both.

SUMMARY OF THE INVENTION

The invention pertains to a sign having a portion being positionable in one of two orientations in order to provide directional information. The sign includes a fixed part having a stationary face thereon for display of desired indicia, and means for securing the fixed part to a surface, such as the beginning of a check out lane. The sign also has a pivotal part which has opposed faces thereon for display of additional indicia. Hinge means is provided for rotatably connecting the pivotal part to the fixed part along one edge of the fixed part, the hinge means including a stop means for positioning the pivotal part in a first orientation with one of the opposed faces deployed and in a second orientation with the other of the two opposed faces deployed.

In accordance with the preferred form of the invention, the hinge means is located such that in the first orientation, the one face of the pivotal part is parallel to the stationary face of the fixed part, and in the second orientation when the pivotal part has been rotated, the other of the opposed faces is positioned such that it covers the stationary face. In this form, the first orientation is such that the one face is above and parallel to the stationary face of the fixed part.

The hinge means includes at least one hinge socket in one of the parts and a hinge pin in the other of the parts which engages the hinge socket. Preferably, a pair of such sockets and a corresponding pair of such pins are employed. In the preferred form, the sockets are located in the fixed part and the pins are located in the pivotal part. In addition, a pair of spaced protrusions are formed on at least one of the pins, with a corresponding spring being formed in the socket in which the pin is located. The protrusions are positioned to engage the spring during rotation of the pivotal part to hold the pivotal part in one of its two orientations. Also, a barrier is provided, extending from the fixed part at the hinge, the barrier engaging one of the opposed faces to prevent rotation of the pivotal part past a predetermined orientation.

For securing the fixed part to a lane surface, at least one attachment pad is provided connected to the fixed part. In accordance with one form of the invention, two or more attachment pads are provided, the pads being pivotally connected to the fixed part by a ball-and-socket joint. In this form of the invention, the ball is secured to the pad and the corresponding socket is secured to the fixed part.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
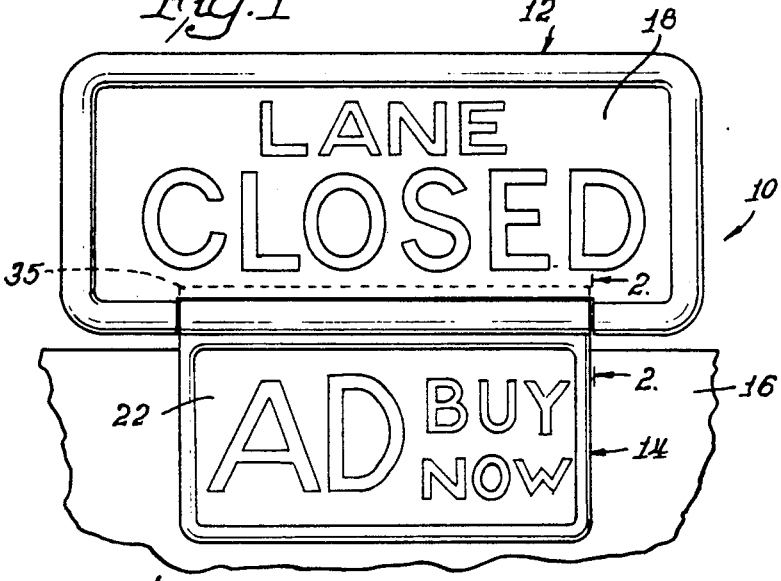
FIG. 1 is a front elevational view of a sign according to the invention, when attached to the face of a check out lane, and with the pivotal part being raised into an upright orientation to signify closing of the lane.
Figure 2:
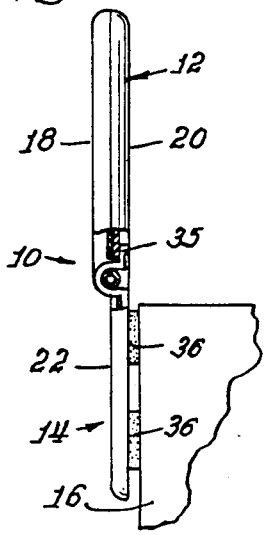
FIG. 2 is a side elevational view of the invention as illustrated in FIG. 1, with a portion shown in section (taken along lines 2—2 of FIG. 1), to show detail.

A lane directional sign according to the invention is shown generally at 10 in the drawing figures. It comprises two basic portions, a pivotal part 12 which is positionable in two orientations in order to provide directional information, and a fixed part 14 which is attached to a vertical front end 16 of a check out lane or any other surface upon which the directional sign according to the invention might be placed.

Figure 3:
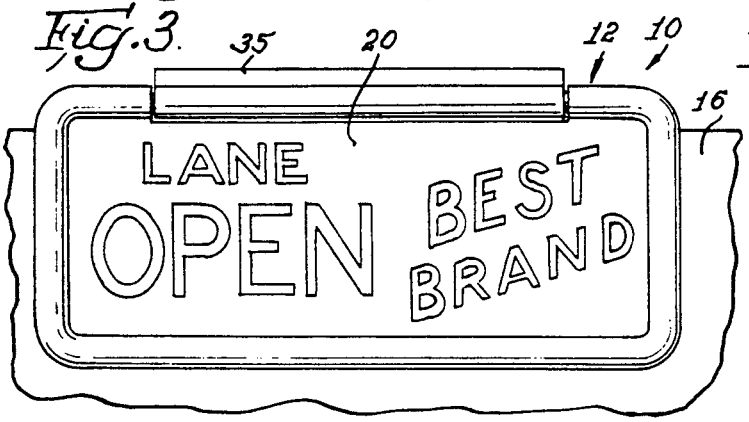
FIG. 3 is a front elevational view similar to FIG. 1, but with the pivotal part having been rotated downwardly to its second orientation to signify opening of a check out lane.
Figure 4:
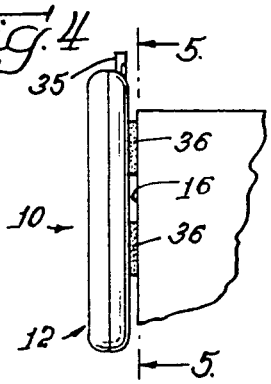
FIG. 4 is a side elevational view, taken from the right side in FIG. 3.

The pivotal part 12 of the sign 10 has opposed faces 18 and 20. As shown in FIGS. 1 and 3, the face 18 is raised and visible when the check out lane is closed. Therefore, the face 18 bears appropriate indicia stating to the customer that the lane is closed. Similarly, the face 20 is visible to the customer when the pivotal part 12 has been rotated downwardly to cover the fixed part 14. When thus rotated, the lane is open, and therefore the face 20 bears appropriate indicia indicating that the lane is open. Either or both of the faces 18 may also carry advertisements, most preferably the face 20 carrying such advertisements since, when the face 20 is visible to the customer in the orientation shown in FIG. 3, any advertisements on the fixed part 14 are not visible. While the faces 18 and 20 are indented on opposite sides of the pivotal part 12, obviously, the faces may be formed otherwise as aesthetics dictate the particular design.

The fixed part 14 has a stationary face 22 which is visible when the pivotal part 12 is raised to the upright orientation shown in FIG. 1, and which is hidden when the pivotal part is rotated downwardly to the orientation shown in FIG. 3. The stationary face 22 may also bear indicia as desired, such as advertisements for products carried in the store in which the sign 10 is located.

Figure 5:
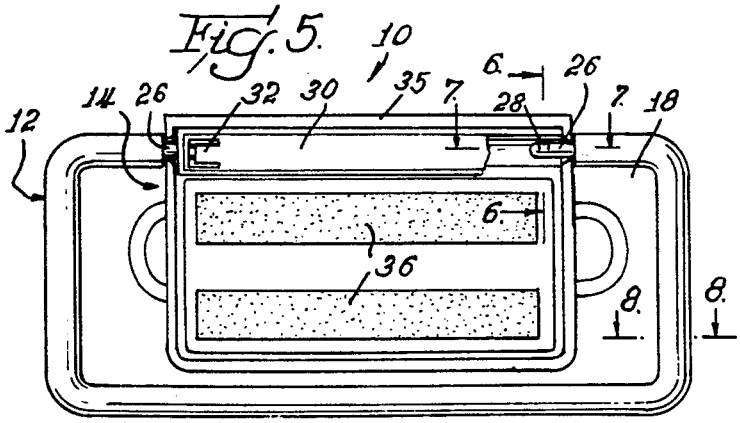
FIG. 5 is a rear elevational view taken along lines 5—5 of FIG. 4, with a portion broken away to illustrate detail.
Figure 6:
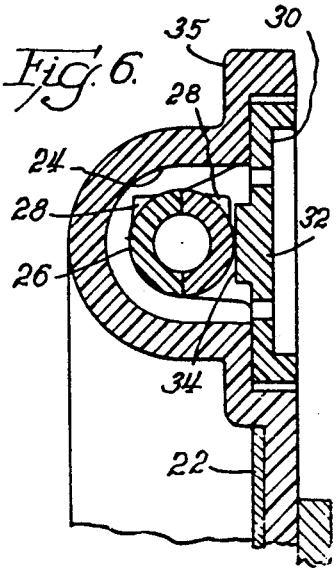
FIG. 6 is an enlarged cross-sectional view taken along lines 6—6 of FIG. 5.
Figure 7:
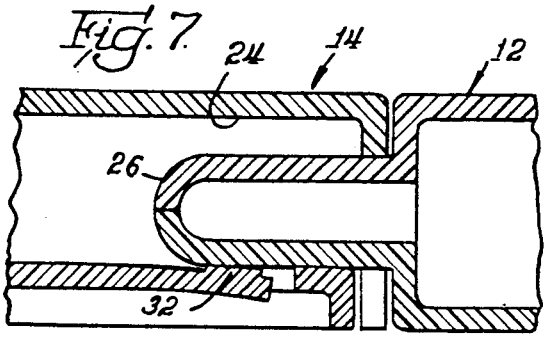
FIG. 7 is an enlarged cross-sectional view taken along lines 7—7 of FIG. 5.
Figure 8:
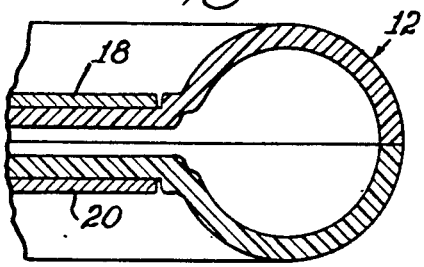
FIG. 8 is an enlarged cross-sectional view taken along lines 8—8 of FIG. 5.

The pivotal part 12 and fixed part 14 are connected by a hinge means extending along the top edge of the fixed part 14, as best shown in FIGS. 5 and 6. The hinge means comprises a hinge socket 24 in the form of an integral channel extending across the top portion of the fixed part 14. At either end of the hinge socket 24, hinge pins 26 connected to the pivotal part 12 are engaged in the socket 24. While the socket 24 extends the width of the fixed part 14, it will be evident that, depending on molding of the parts of the sign 10, the socket 24 can comprise a pair of unconnected sockets each formed only large enough to accommodate its respective hinge pin 26.

It is preferred that the sign 10 be able to be temporarily oriented in either the upright orientation shown in FIG. 1, or the downward orientation shown in FIG. 3. To that end, at least one of the pins 26, and preferably both, include spaced protrusions 28. The hinge socket 24 is closed by a backing plate 30, the plate 30 having formed therein living springs 32, each of which has a bearing surface 34 in close proximity to its associated hinge pin 26. The protrusions 28 engage the bearing surface 34 when the pivotal part 12 is rotated, the spring force of the springs 32 thus acting to maintain the sign 10 in one of the two orientations shown in FIGS. 1 and 3 by the interrelationship of the springs 32 and protrusions 28.

In addition, a barrier 35 is formed extending across the top of the fixed part 14. The geometry is such that the barrier 35 engages the rear face 20 when the pivotal part 12 is raised to the upright orientation shown in FIG. 1, thus preventing rotation of the pivotal part 12 past the upright orientation shown.

The sign 10 preferably is provided with one or more foam pads 36 secured to the backside of the fixed part 14. The pad or pads 36 are formed with adhesive on both sides and with release strips (not illustrated) on the exposed side so that the released strips can be removed and the sign 10 adhesively adhered to the lane face 16. For a flat lane face, other means of attachment can also be employed, as would be evident to one skilled in the art.

When the lane face 16 is other than flat, however, attachment with the flat foam pads 36 may not be functional. For example, with a lane face 16' shown in FIG. 10, the foam pads 36 may not properly adhere. Thus, in the form of the invention shown in FIGS. 9–11, the foam pads 36 are replaced by a pair of attachment pads 38, which are best shown in FIGS. 9*a* and 11. Each attachment pad consists of a rigid member 40 having an adhesive foam pad 42 secured thereto. The attachment pad 38 is secured to the back of the fixed part 14 by means of a pair of ball-and-socket joints composed of a ball 44 formed as an integral part of the rigid member 40 and a socket 46 formed in the back of the fixed part 14. The ball 44 snaps into the socket 46, as shown in FIG. 11, allowing the attachment pad 38 to be pivoted relative to the fixed part 14 to accommodate curved faces of check out lanes, such as the curved face 16' shown in FIG. 10.

Figure 9:
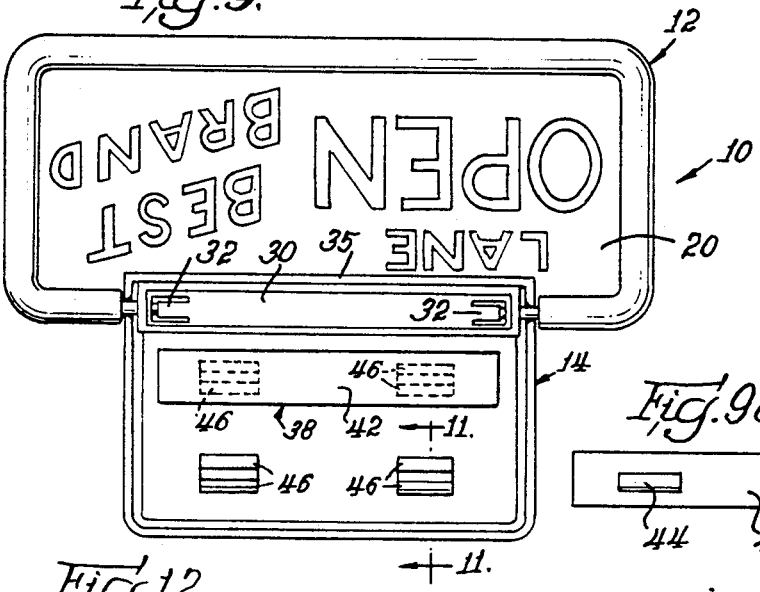
FIG. 9 is a rear elevational view of a second form of the invention having a different means for securing the invention to the face of a check out lane.
Figure 10:
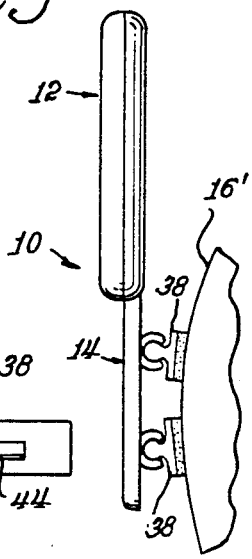
FIG. 10 is a side elevational view of the form of the invention shown in FIG. 9, taken from the left of that figure, and showing the sign being attached to the face of a lane that has a non-planar surface.
Figure 9A:
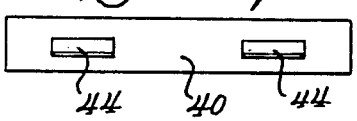
FIG. 9*a* is an elevational view of one of the attachment pads used in the form of the invention shown in FIG. 9.
Figure 12:
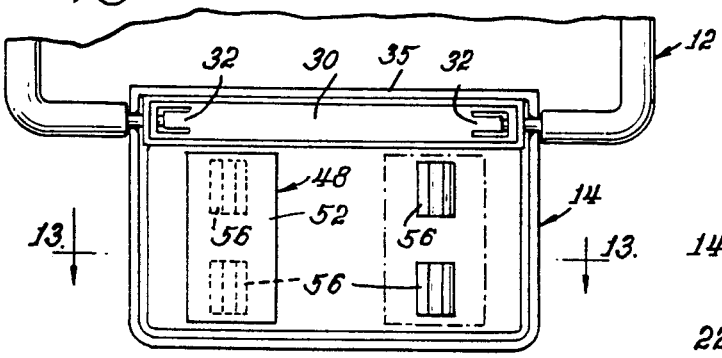
FIG. 12 is a rear elevational view, with portions eliminated, of another form of the invention having a different means of securing the invention to a surface.
Figure 11:
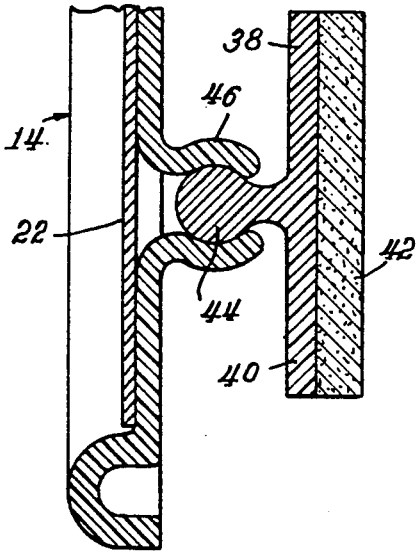
FIG. 11 is an enlarged cross-sectional view taken along lines II—II of FIG. 9.
Figure 13:
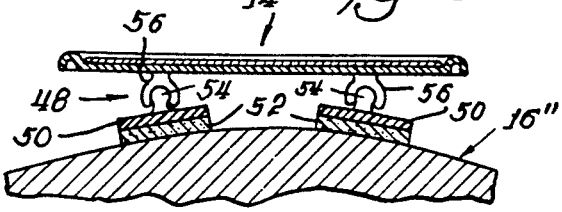
FIG. 13 is a cross-sectional view taken along lines 13—13 of FIG. 12, and showing this form of the invention attached to a different lane face that has a non-planar surface.

FIGS. 12 and 13 illustrate a further modification from that shown in FIGS. 9–11, where the lane face 16" is curved in the horizontal dimension rather than in the vertical dimension. The attachment pads 48 shown in FIGS. 12 and 13 are each comprised of a rigid backing member 50 and adhesive foam pad 52, and are secured vertically to the fixed part 14 by means of a ball-and-socket joint comprised of a ball 54 and a socket 56. The ball-and-socket joint is identical to that of FIGS. 9–11.

Various changes can be made to the invention without departing from the spirit thereof or scope of the following claims.

What is claimed is:

1. A sign having a portion being positionable in two orientations in order to provide directional information, the sign comprising a. a fixed part having a stationary face thereon for display of indicia, b. means for securing said fixed part to a surface, c. a pivotal part having opposed faces thereon for display of indicia, d. hinge means rotatably connecting said pivotal part to said fixed part along one edge of said fixed part, said hinge means including stop means for positioning said pivotal part in a first orientation with one of said opposed faces deployed and in a second orientation with the other of said opposed faces deployed, and e. said hinge means including a hinge socket in one of said parts and a hinge pin in the other of said parts engaging said socket, said stop means comprising at least one protrusion formed on said pin and a spring extending into said socket adjacent said pin, said protrusion being located to engage said spring during rotation of said pivotal part.

2. A sign according to claim 1 in which said hinge means is located such that in said first orientation said one face is parallel to said stationary face and in said second orientation said other face covers said stationary face.

3. A sign according to claim 2 in which in said first orientation said one face is above said stationary face.

4. A sign according to claim 1 including a pair of said sockets and a corresponding pair of said pins.

5. A sign according to claim 1 in which said socket is located in said fixed part and said pin is located in said pivotal part.

6. A sign according to claim 1 in which said stop means comprises a pair of spaced protrusions formed on said pin, said protrusions being located to engage said spring during rotation of said pivotal part.

7. A sign according to claim 6 including barrier means extending from said fixed part at said hinge means, said barrier means engaging one of said opposed faces to prevent rotation of said pivotal part past a predetermined orientation.

8. A sign according to claim 7 in which said predetermined orientation is one of said first and second orientations.

9. A sign according to claim 1 in which said securing means comprises at least one attachment pad connected to said fixed part.

10. A sign according to claim 9 including means pivotally connecting said pad to said fixed part.

11. A sign according to claim 10 in which said means pivotally connecting comprises a ball-and-socket joint.

12. A sign according to claim 1 in which said securing means comprises a pair of attachment pads and means pivotally connecting said pads to said fixed part.

13. A sign according to claim 12 in which said means pivotally connecting comprises at least one ball-and-socket joint for each of said pads.

14. A sign according to claim 13 in which each of said ball-and-socket joints includes a ball secured to a said pad and a corresponding socket secured to said fixed part.

15. A sign having a portion being positionable in two orientations in order to provide directional information, the sign comprising a. a fixed part having a stationary face thereon for display of indicia, b. at least one attachment pad connected to said fixed part for securing said fixed part to a surface, c. a pivotal part having opposed faces thereon for display of indicia, d. hinge means rotatably connecting said pivotal part to said fixed part along a top edge of said fixed part, said hinge means including stop means for positioning said pivotal part in a first orientation above and parallel to said stationary face with one of said opposed faces deployed, and in a second orientation with the other of said faces covering said stationary face, and e. said hinge means including a pair of hinge sockets located in said fixed part and a pair of corresponding hinge pins extending from said pivotal part and engaging said sockets, said stop means comprising a pair of spaced protrusions formed on at least one of said pins and a spring protruding into at least one of said sockets adjacent said one pin, said protrusions being located to engage said spring during rotation of said pivotal part.

16. A sign according to claim 15 including means pivotally connecting said pad to said fixed part.

17. A sign according to claim 16 in which said means pivotally connecting comprises a ball-and-socket joint.

* * * * *